US009377738B2

(12) United States Patent
Ishihara

(10) Patent No.: US 9,377,738 B2
(45) Date of Patent: Jun. 28, 2016

(54) IMAGE FORMING APPARATUS WHICH PREVENTS A SHEET JAM CAUSED BY A SHEET ATTACHED TO AN IMAGE BEARING MEMBER

(71) Applicant: CANON KABUSHIKI KAISHA, Tokyo (JP)

(72) Inventor: Shotaro Ishihara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/488,600

(22) Filed: Sep. 17, 2014

(65) Prior Publication Data

US 2015/0104204 A1 Apr. 16, 2015

(30) Foreign Application Priority Data

Oct. 10, 2013 (JP) ..... 2013-212640

(51) Int. Cl.
*G03G 15/00* (2006.01)
*G03G 15/16* (2006.01)

(52) U.S. Cl.
CPC ..... *G03G 15/5012* (2013.01); *G03G 15/1615* (2013.01); *G03G 15/657* (2013.01); *G03G 15/70* (2013.01)

(58) Field of Classification Search
CPC ..... G03G 15/657; G03G 15/1615; G03G 15/5012; G03G 15/70; G03G 15/706; G03G 2215/00548
See application file for complete search history.

(56) References Cited

U.S. PATENT DOCUMENTS

2012/0207485 A1* 8/2012 Iwakawa ..... 399/16
2012/0263487 A1* 10/2012 Itaya ..... 399/68

FOREIGN PATENT DOCUMENTS

| | | | |
|---|---|---|---|
| JP | 06024607 | A | 2/1994 |
| JP | 11-59962 | A | 3/1999 |
| JP | 2003140488 | A | 5/2003 |
| JP | 3687296 | B2 | 8/2005 |
| JP | 4046976 | B2 | 2/2008 |
| JP | 2008185678 | A | 8/2008 |

OTHER PUBLICATIONS

Machine Translation of JP 2003-140488 to Takashi et al. published on May 14, 2003.*

* cited by examiner

*Primary Examiner* — Blake A Tankersley
(74) *Attorney, Agent, or Firm* — Fitzpatrick, Cella, Harper & Scinto

(57) ABSTRACT

An image forming apparatus comprising: an image bearing member which bears a toner image; a first driving portion which drives the image bearing member; a transfer portion which nips a sheet with the image bearing member and transfers the toner image to the sheet from the image bearing member; a sheet conveying portion which conveys the sheet with the toner image transferred by the transfer portion; a second driving portion which drives the sheet conveying portion; a sheet detector which detects the sheet between the transfer portion and the sheet conveying portion; and a controller which controls the second driving portion to drive the sheet conveying portion to convey the sheet after the first driving portion is stopped, so that the sheet detector can detect the sheet nipped between the image bearing member and the transfer portion.

7 Claims, 10 Drawing Sheets

IMAGE FORMING APPARATUS WHICH PREVENTS A SHEET JAM CAUSED BY A SHEET ATTACHED TO AN IMAGE BEARING MEMBER

BACKGROUND OF THE INVENTION

1. Field of the Invention

The present invention relates to an image forming apparatus which employs an electrophotographic system.

2. Description of the Related Art

As an image forming apparatus employing the electrophotographic system, there is an image forming apparatus which uses an intermediate transfer belt. Such an image forming apparatus is provided with photosensitive drums serving as image bearing members as many as colors (for example, four colors) necessary for forming an image. Each photosensitive drum is provided with a charging portion, an exposing portion, and a developing portion in the vicinity thereof.

Then, after a monochrome toner image formed on the photosensitive drum is primarily transferred onto the intermediate transfer belt, the toner image primarily transferred on the intermediate transfer belt is secondarily transferred onto a sheet, so that an unfixed image is formed. The sheet with the unfixed image formed thereon is conveyed to the fixing portion to fix the unfixed image, and then discharged from the image forming apparatus.

The image forming apparatus is desirable to support a wide variety of sheets such as in size and in basis weight. However, an image forming apparatus in the related art has a problem in that when the toner image is secondarily transferred onto a thin sheet having a basis weight of 52 g/m$^2$ or less or a sheet having a low stiffness (strength of the middle portion), the sheet may be wound up without being separated from the outer peripheral surface of the intermediate transfer belt.

The sheet wound up in the outer peripheral surface of the intermediate transfer belt may enter places other than a sheet conveying path, so that there is a possibility to make a jam processing operation difficult or to cause trouble in the image forming apparatus.

In Japanese Patent Laid-Open No. 11-59962, a sheet detection sensor is provided on a downstream side in a sheet conveying direction of a secondary transfer portion in order to detect whether the leading end of the sheet is wound up in the outer peripheral surface of the intermediate transfer belt. Further, there is proposed a technology in which when it is determined that there is no sheet on the sheet conveying path, driving operations of the intermediate transfer belt and other conveying rollers are stopped.

Other portions of the sheet besides the leading end may be wound up to the outer peripheral surface of the intermediate transfer belt. For example, when a jam occurs in the sheet, and in a case where a driving portion of the intermediate transfer belt is stopped in a state where the sheet is interposed in the secondary transfer portion, the driving portion of the intermediate transfer belt rotates in some degree by its own inertia even after the driving portion is stopped.

Therefore, a loop is formed in the sheet between the secondary transfer portion and a sheet conveying portion which is provided on the sheet conveying path from the secondary transfer portion to the fixing portion. Then, the intermediate transfer belt is stopped in a state where the middle portion of the sheet with the loop formed thereon is wound up to the outer peripheral surface of the intermediate transfer belt.

In this state, as described in Japanese Patent Laid-Open No. 11-59962, it is not possible to detect the sheet using the sheet detection sensor which is provided on the downstream side in the sheet conveying direction of the secondary transfer portion. In a case where the next printing job starts without processing the jam of the sheet in this state, the sheet in the wound state is conveyed to the outer peripheral surface of the intermediate transfer belt, so that there is a possibility for the sheet to enter places other than the sheet conveying path.

The invention has been made in order to solve the above problem, and it is desirable to provide an image forming apparatus which can prevent a sheet jam caused by a sheet attached to the outer peripheral surface of the image bearing member.

SUMMARY OF THE INVENTION

A representative configuration of an image forming apparatus according to the invention in order to attain the objective includes an image bearing member which bears a toner image; a first driving portion which drives the image bearing member; a transfer portion which nips a sheet with the image bearing member and transfers the toner image to the sheet from the image bearing member; a sheet conveying portion which conveys the sheet with the toner image transferred by the transfer portion; a second driving portion which drives the sheet conveying portion; a sheet detector which detects the sheet between the transfer portion and the sheet conveying portion; and a controller which controls the second driving portion to drive the sheet conveying portion to convey the sheet after the first driving portion is stopped, so that the sheet detector can detect the sheet nipped between the image bearing member and the transfer portion.

Further features of the present invention will become apparent from the following description of exemplary embodiments with reference to the attached drawings.

DESCRIPTION OF THE EMBODIMENTS

An embodiment of an image forming apparatus according to the invention will be described in detail with reference to the drawings.

First Embodiment

Figure 1:
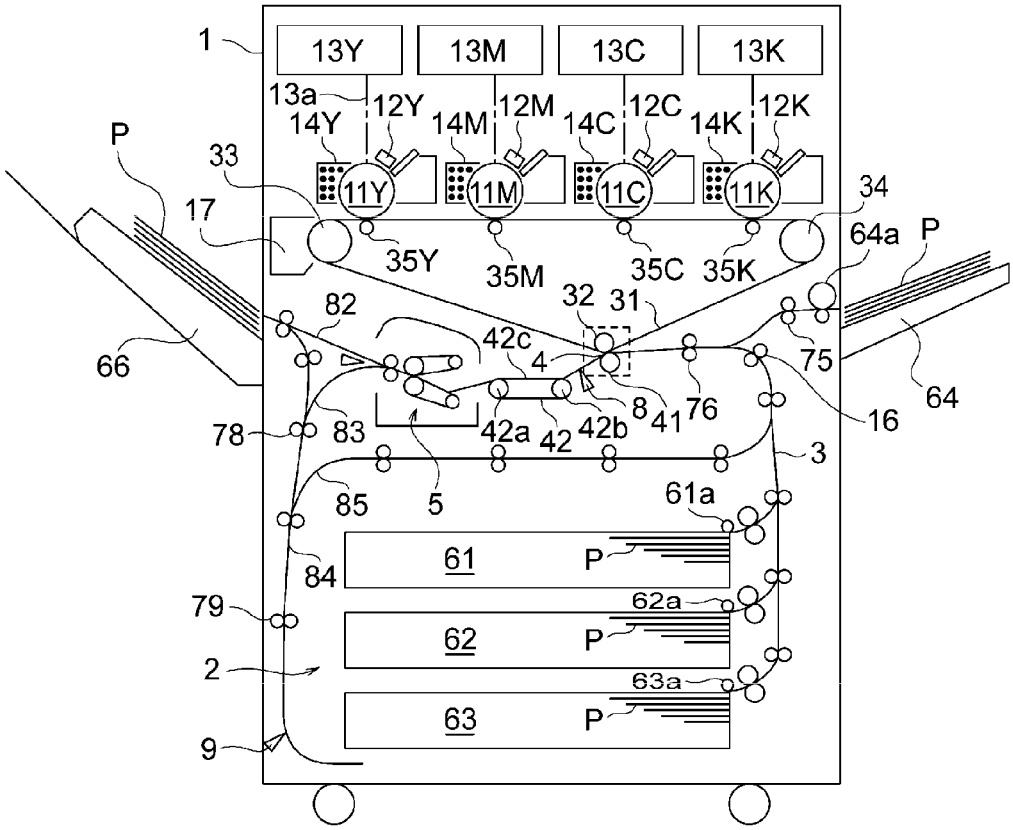
FIG. 1 is a cross-sectional view illustrating a structure of an image forming apparatus according to the invention.

First, the configuration of a first embodiment of the image forming apparatus according to the invention will be described using FIG. 1 to FIGS. 8A and 8B. An image forming apparatus 1 illustrated in FIG. 1 is provided with an intermediate transfer belt 31 as an image bearing member which bears a toner image. The image forming apparatus 1 of the embodiment is applicable to a copying machine, a printer, a facsimile apparatus, and a multifunction peripheral thereof.

The image forming apparatus 1 of the embodiment is an image forming apparatus employing an intermediate transfer system in which toner images formed on surfaces of photosensitive drums 11Y, 11M, 11C, and 11K serving as image bearing members which carry the toner images are primarily transferred onto the outer peripheral surface of the intermediate transfer belt 31 and then secondary transferred onto a sheet P.

In the embodiment, the description will be made using the image forming apparatus 1 of the intermediate transfer system in which image forming units of four colors (yellow Y, magenta M, cyan C, and black K) are disposed on the outer peripheral surface of the intermediate transfer belt 31. Further, for convenience sake, the photosensitive drums 11Y, 11M, 11C, and 11K may be described using the photosensitive drum 11 as a representative. The descriptions of the other image forming units will be also the same.

<Image Forming Apparatus>

Figure 2A:
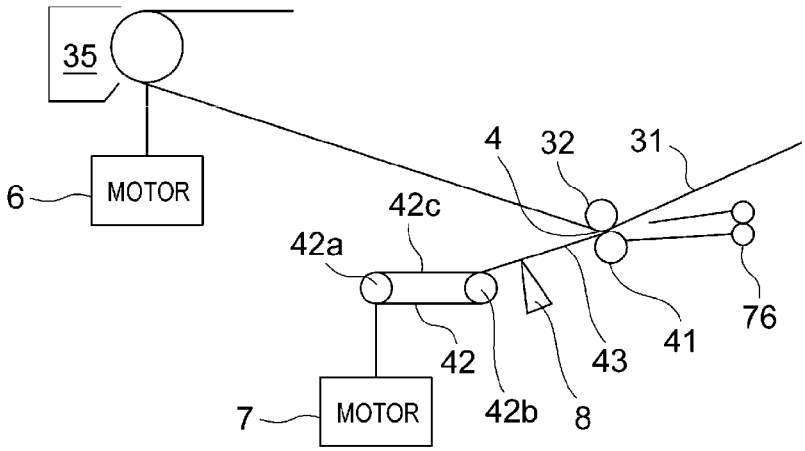
FIG. 2A is a cross-sectional view schematically illustrating a configuration of a secondary transfer portion of the image forming apparatus according to the invention.

First, the configuration of the image forming apparatus 1 will be described using FIGS. 1 and 2A. FIG. 1 is a cross-sectional view for describing the configuration of the image forming apparatus 1. FIG. 2A is a cross-sectional view schematically illustrating the configuration in the vicinity of a secondary transfer portion 4 of the image forming apparatus 1. First, a sheet feeding process in which the sheet P is fed up to the secondary transfer portion 4 by a sheet feeding portion 2 will be described using FIG. 1. The sheets P are stored in each of sheet cassettes 61 to 63 which are provided below the image forming apparatus 1.

The sheets P stored in the respective sheet cassettes 61 to 63 are fed from the sheet cassette 61 to 63 by feeding rollers 61*a* to 63*a*, respectively. Further, in the embodiment, the image forming apparatus 1 is provided with a manual feeding tray 64 on the side portion through which the sheet can be fed in manual. The configuration allows the sheet P to be fed also from the manual feeding tray 64 by a feeding roller 64*a*.

The sheets P fed by the feeding rollers 61*a* to 64*a* pass through a separation portion and are separated one by one, and are conveyed through a conveying path 3 to a registration roller 76 which is disposed on an upstream side in a sheet conveying direction of the secondary transfer portion 4 (hereinafter, simply referred to as an "upstream"). The leading end of the fed sheet P comes into conflict with a nip portion of the stopping registration roller 76, and the sheet P is further conveyed by conveying rollers 16 and 75 which are on the upstream side from the registration roller 76, thereby forming a loop in the sheet P.

The leading end of the sheet P is arranged along the nip portion of the registration roller 76 by strength of the middle portion of the sheet P caused by the loop formation. Therefore, skew feeding of the sheet P is corrected. In addition, the registration roller 76 conveys the sheet P to the secondary transfer portion 4 at a timing point when an image is formed onto the sheet P, that is, at a predetermined timing point in synchronization with the rotation of the intermediate transfer belt 31 on which the toner image is primarily transferred from the photosensitive drum 11. In this way, the registration roller 76 corrects the skew feeding of the sheet P, and conveys the sheet P to the secondary transfer portion 4 at a predetermined timing point.

<Image Forming Portion>

Next, the configuration of the image forming portion will be described. In FIG. 1, the surfaces of the four photosensitive drums 11Y to 11K serving as the image bearing members which carry the toner image each are uniformly charged by charging apparatuses 12Y to 12K serving as charging portions. Image signals of yellow Y, magenta M, cyan C, and black K are input to laser scanners 13C to 13K serving as exposing portions, respectively. The surface of the photosensitive drum 11 is irradiated with a laser beam 13*a* according to the image signal, and surface charges of the photosensitive drum 11 are neutralized to form an electrostatic latent image.

The electrostatic latent images formed on the surfaces of the respective photosensitive drums 11 are developed with toners of yellow Y, magenta M, cyan C, and black K by developing apparatuses 14Y to 14K serving as developing portions, respectively. The toners developed on the surfaces of the respective photosensitive drums 11 are sequentially transferred onto the outer peripheral surface of the intermediate transfer belt 31 which serves as the image bearing members to carry the toner images and are formed of an endless belt suspended on primary transfer rollers 35Y to 35K serving as a primary transfer portion. Therefore, a full color toner image is formed on the outer peripheral surface of the intermediate transfer belt 31.

The intermediate transfer belt 31 carries the full color toner image primarily transferred from the respective photosensitive drums 11Y to 11K, and conveys the full color toner image to the secondary transfer portion 4 at a timing point in synchronization with the conveying process of the sheet P. The intermediate transfer belt 31 is rotatably suspended on a driving roller 33, a tension roller 34, and a secondary transfer inner-roller 32.

Figure 3:
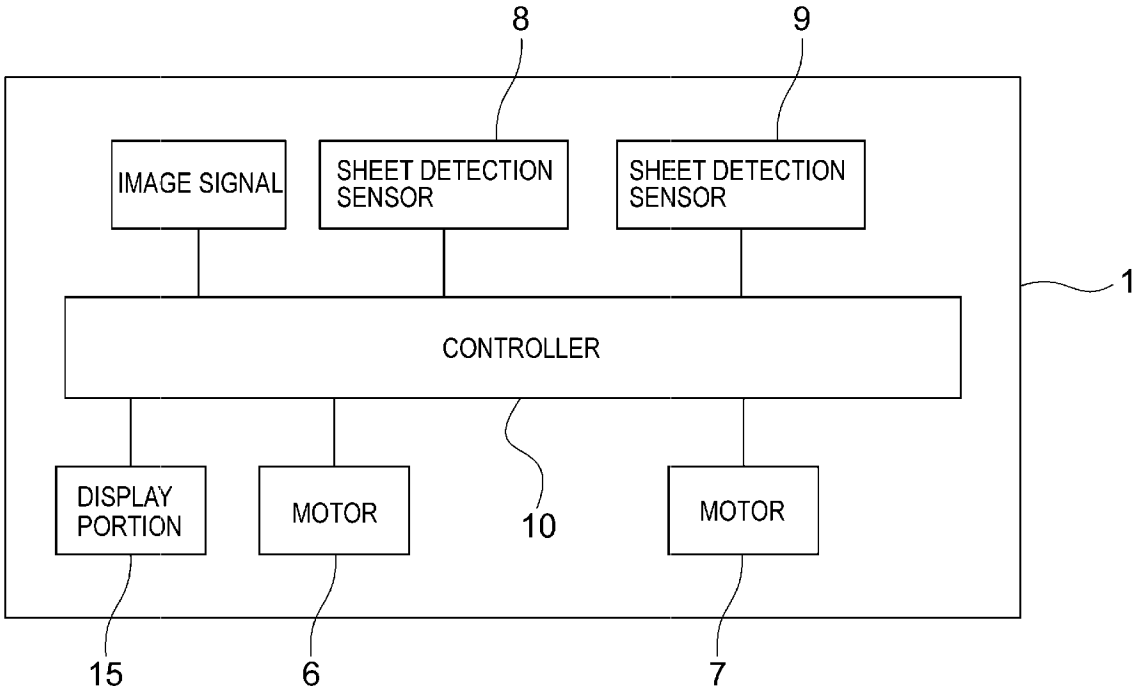
FIG. 3 is a block diagram illustrating a configuration of a control system of the image forming apparatus according to the invention.

A motor 6 serving as a first driving portion which is under electric control of a controller 10 illustrated in FIG. 3 rotatably drives the driving roller 33 through a driving transmission portion (not illustrated), so that the intermediate transfer belt 31 is rotatably driven. The motor 6 of the embodiment is configured using a DC motor.

Next, a secondary transfer process and the subsequent processes of the secondary transfer portion 4 will be described. The secondary transfer portion 4 is provided with the secondary transfer inner-roller 32 which is disposed on an inner peripheral surface side of the intermediate transfer belt 31, and a secondary transfer outer-roller 41 which serves as a secondary transfer portion facing the secondary transfer inner-roller 32 with the intermediate transfer belt 31 interposed therebetween.

The secondary transfer portion 4 applies a predetermined pressure and electrostatic load bias onto the sheet P in a nip portion between the secondary transfer inner-roller 32 and the secondary transfer outer-roller 41 with the intermediate transfer belt 31 interposed therebetween. With this configuration, the full color toner image carried on the outer peripheral surface of the intermediate transfer belt 31 is secondarily transferred onto the sheet P. The secondary transfer outer-roller 41 of the embodiment is disposed to face the intermediate transfer belt 31 serving as the image bearing member, and is configured to serve as a transfer portion which transfers the toner image onto the sheet P from the outer peripheral surface of the intermediate transfer belt 31.

After the toner image is transferred onto the sheet P from the outer peripheral surface of the intermediate transfer belt 31, the residual toner left on the outer peripheral surface of the intermediate transfer belt 31 is scrapped off and removed by the cleaning unit 17 serving as a cleaning portion.

The full color toner image is secondarily transferred onto the sheet P in the secondary transfer portion 4. Then, the sheet P is nipped and conveyed by the secondary transfer outer-roller 41 and the intermediate transfer belt 31 which serve as a transfer portion. Furthermore, the sheet P on which the toner image is transferred from the outer peripheral surface of the intermediate transfer belt 31 is conveyed by a sheet conveying portion 42 to a fixing apparatus 5 serving as a fixing portion.

The sheet conveying portion 42 of the embodiment is configured such that a sheet conveying belt 42*c* formed of an endless belt is rotatably suspended by a driving roller 42*a* and a suspending roller 42*b*. A motor 7 serving as a second driving portion which is under electric control of the controller 10 illustrated in FIG. 3 is connected to the driving roller 42*a* through a driving transmission portion (not illustrated) and rotatably drives the driving roller. Therefore, the sheet conveying belt 42*c* is rotatably driven in a direction conveying the sheet P from the secondary transfer portion 4 to the fixing apparatus 5. In the embodiment, the sheet conveying belt 42*c* serving as the sheet conveying portion is rotatably driven by the motor 7 serving as the second driving portion.

The sheet conveying belt 42*c* of the embodiment is provided with a number of air holes for absorbing the sheet. The sheet conveying portion 42 applies a negative pressure generated by a fan (not illustrated) to the sheet P to be absorbed to the outer peripheral surface of the sheet conveying belt 42*c*.

As illustrated in FIG. 2A, the driving roller 42*a* which rotatably drives the sheet conveying belt 42*c* of the sheet conveying portion 42 is rotatably driven by the motor 7 through a driving transmission portion (not illustrated). In the embodiment, a stepping motor is used as an example of the motor 7.

A sheet conveying path from the secondary transfer portion 4 (which is formed of the nip portion between the secondary transfer inner-roller 32 and the secondary transfer outer-roller 41 with the intermediate transfer belt 31 interposed therebetween) to the sheet conveying portion 42 is formed by a lower guide 43. The lower guide 43 is disposed between the secondary transfer portion 4 and the sheet conveying portion 42. Then, the lower face of the sheet P is guided by the lower guide 43.

The toner image secondarily transferred by the secondary transfer portion 4 is transferred onto the upper face of the sheet P. For this reason, the upper guide to guide the upper face of the sheet P is not provided above the lower guide 43. Therefore, the sheet P is guided along the upper face of the lower guide 43.

A sheet detection sensor 8 serving as a sheet detector is disposed between the secondary transfer outer-roller 41 (which is on the lower side of the secondary transfer portion 4 and serves as the transfer portion on the sheet conveying path) and the sheet conveying portion 42 in order to detect whether or not there is a secondarily-transferred sheet P conveyed along the sheet conveying path.

The sheet detection sensor 8 of the embodiment is configured by a reflection type of optical sensor. The optical sensor irradiates light using a light source (not illustrated) and receives a reflected light from the sheet P in a case where the sheet P is present on the lower guide 43, and then outputs a detection signal indicating that the sheet P is present. The optical sensor is disposed to irradiate light from the lower side of the sheet conveying path to the upward through an opening (not illustrated) which is formed in the lower guide 43.

The fixing apparatus 5 melts and fixes the toner image secondarily transferred on the sheet P with a predetermined pressure caused by facing rollers or belts and with a predetermined heat generated by a heating source such as a heater. The sheet P on which the toner image is fixed by the fixing apparatus 5 is discharged onto a discharge tray 66 through a discharge path 82.

In addition, in a case where images are formed on both faces of the sheet P, the sheet P conveyed onto a reversing path 83 is once drawn into from the reversing path 83 to a switchback path 84. Then, the leading and trailing ends of the sheet P are exchanged by a switchback operation in which the rotation direction of a reversing roller 79 is forwardly or reversely changed, and the sheet is conveyed onto a duplex conveying path 85.

Then, the sheet P joins the conveying path 3 at a timing point in synchronization with a sheet P which is fed from the sheet cassettes 61 to 63 or the manual feeding tray 64 for the next printing job, and then is conveyed again to the secondary transfer portion 4 through the registration roller 76. Further, since an image forming process on the rear face (the face at the second printing time) of the sheet P is the same as the above-mentioned image forming process of the front face (the face at the first printing time) of the sheet P, the redundant description will not be repeated.

In addition, in a case where the sheet P is reversely discharged, the sheet P is drawn into from the reversing path 83 to the switchback path 84 after the sheet P passes through the fixing apparatus 5. Then, while the reversing rollers 78 and 79 are reversely driven, the trailing end of the sheet P when it enters the switchback path 84 is set as the head and withdrawn in a direction opposite to the entering direction, so that the sheet is reversely discharged onto the discharge tray 66.

<Residual Sheet Detecting Operation when Jam Occurs>

Next, a description will be made about a residual sheet detecting operation, using FIGS. 2B and 2C, which is performed by the controller 10 of the image forming apparatus 1 when the sheet P is jammed.

In the embodiment, in a case where the sheet P is not detected for a predetermined time by a sheet detection sensor 9 serving as a sheet detector provided on the switchback path 84 illustrated in FIG. 1, the controller 10 determines that the sheet P is jammed.

Then, after the jam is detected by the sheet detection sensor 9, the controller 10 performs the following control. In other words, the controller stops all the sheet conveying motors which are provided in the image forming apparatus 1, including the motor 6 which rotatably drives the driving roller 33 to rotatably rotate the intermediate transfer belt 31 and the motor 7 which rotatably drives the driving roller 42*a* to rotatably rotate the sheet conveying belt 42*c*.

Figure 2B:
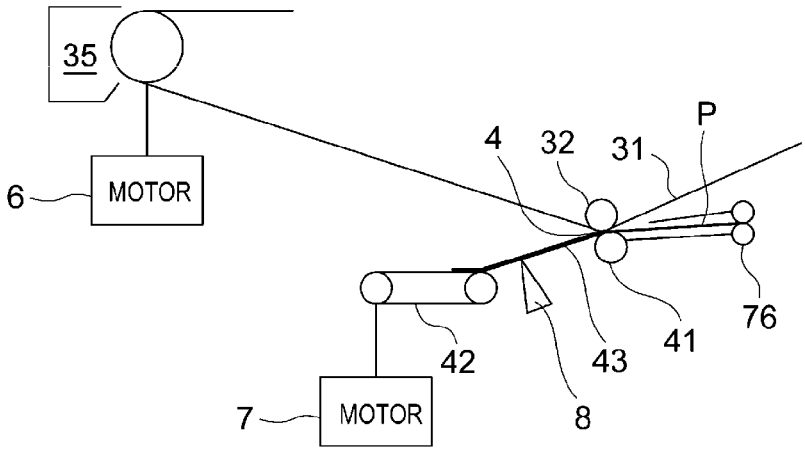
FIG. 2B is a cross-sectional view schematically illustrating a state of detecting a residual sheet in the secondary transfer portion of the image forming apparatus according to the invention.

After the stopping of the respective sheet conveying motors, in a case where the sheet P is present between the secondary transfer portion 4 and the sheet conveying portion 42 as illustrated in FIG. 2B, a residual sheet P can be detected by the sheet detection sensor 8, and it is possible to urge a user to take a step for a jam processing operation.

However, in practice, even when the motor 6 is stopped, the intermediate transfer belt 31 continuously rotates due to an inertial force of the intermediate transfer belt 31. As a result, the sheet P between the secondary transfer portion 4 and the sheet conveying portion 42 forms a convex loop illustrated in FIG. 2C, so that the sheet detection sensor 8 may fail to detect the residual sheet P.

The intermediate transfer belt 31 comes into contact with the photosensitive drum 11Y and the like. At the time when the sheet detection sensor 9 detects the jam of the sheet P, the controller 10 stops the motor 6 which rotatably drives the intermediate transfer belt 31. However, it is not possible to instantaneously stop the intermediate transfer belt 31 due to an influence of an inertial force by the weight of the intermediate transfer belt 31 and an inertial force of the photosensitive drum 11Y.

In particular, since the image forming apparatus 1 is operated in high speed of the intermediate transfer belt 31 to satisfy a high productivity, the above situation is remarkable. In addition, the sheet P is charged up by an electrostatic load bias applied from the secondary transfer outer-roller 41 in the secondary transfer portion 4.

Figure 2C:
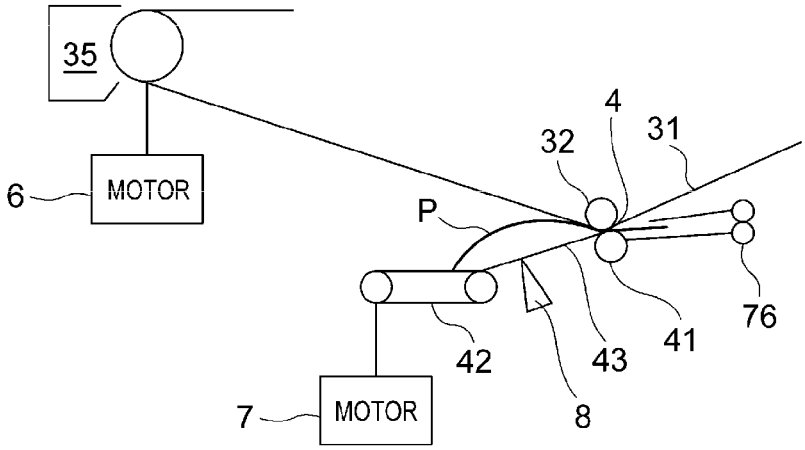
FIG. 2C is a cross-sectional view schematically illustrating a state of detecting a residual sheet in the secondary transfer portion of the image forming apparatus according to the invention.

Therefore, for example, in the case of a sheet P such as a thin sheet having a small basis weight, as illustrated in FIG. 2C, the sheet P is wound up from the middle portion to form a loop in the outer peripheral surface of the intermediate transfer belt 31 at the time when the image forming apparatus 1 is stopped due to the sheet jam. Such a loop causes the sheet P to depart from a detection region of the sheet detection sensor 8. Therefore, it is not possible to detect the residual sheet P.

In such a state, the user may perform the next printing job when the image forming apparatus 1 is stopped, while the jam process is not clearly performed on the sheet P of which the middle portion is wound up in the outer peripheral surface of the intermediate transfer belt 31. If so, the sheet P departs from the sheet conveying path while being attached to the outer peripheral surface of the intermediate transfer belt 31 and goes beyond the upper portion of the fixing apparatus 5, so that the sheet P may enter a space other than the conveying path of the sheet P.

For example, in a case where a sheet P having a small length in the sheet conveying direction is conveyed, the entire sheet P up to the trailing end may enter the cleaning unit 17. When the sheet P enters the cleaning unit 17, the jam processing becomes difficult for the user.

<Stop Control Operation of Sheet Conveying Portion>

Figure 4:
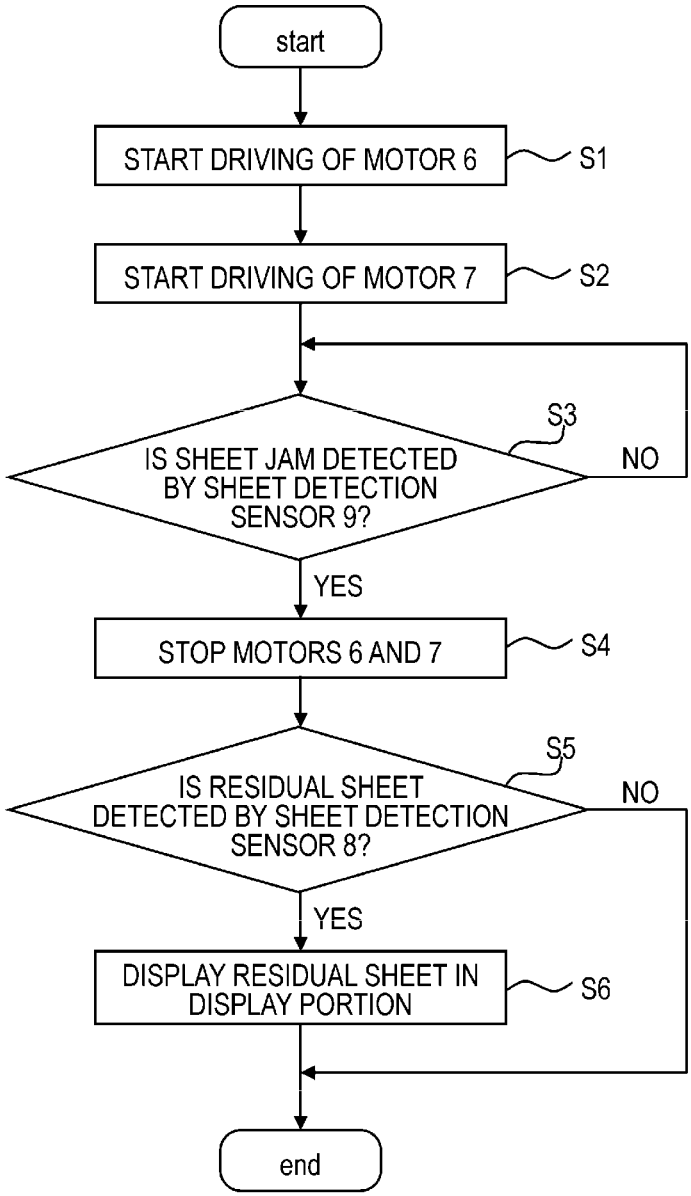
FIG. 4 is a flowchart illustrating stop control of an intermediate transfer belt and a sheet conveying belt when a sheet jam occurs in a first embodiment of the image forming apparatus according to the invention.

Next, a description will be made, using FIGS. 3 to 8, about stop control which is performed on the intermediate transfer belt 31 and the sheet conveying portion 42 by the controller 10 of the image forming apparatus 1 when the jam occurs. FIG. 3 is a block diagram illustrating a control system including the controller 10 which performs the stop control on the intermediate transfer belt 31 and the sheet conveying portion 42 when the sheet P is jammed in the image forming apparatus 1. FIG. 4 is a flowchart illustrating states in which the stop control on the intermediate transfer belt 31 and the sheet conveying portion 42 is performed by the controller 10 of the image forming apparatus 1 when the jam occurs.

As illustrated in FIG. 3, the controller 10 of the image forming apparatus 1 is electrically connected to the motor 6 which rotatably drives the intermediate transfer belt 31 and the motor 7 which rotatably drives the sheet conveying belt 42*c*. When a predetermined image signal is input, the controller 10 controls the driving of the motor 6 which rotatably drives the intermediate transfer belt 31 and the motor 7 which rotatably drives the sheet conveying belt 42*c*.

Further, the controller performs the stop control including deceleration control on the motor 6 which rotatably drives the intermediate transfer belt 31 and the motor 7 which rotatably drives the sheet conveying belt 42*c* based on the detection result of a jam of the sheet P by the sheet detection sensor 9 serving as the sheet detector.

The stop control operation of the controller 10 on the motor 6 which rotatably drives the intermediate transfer belt 31 and the motor 7 which rotatably drives the sheet conveying belt 42*c* will be described using FIG. 4.

As illustrated in FIG. 4, when the image forming apparatus 1 starts a printing job, the motor 6 which rotatably drives the intermediate transfer belt 31 starts to drive in Step S1, and an image forming operation starts. Next, in Step S2, the motor 7 which rotatably drives the sheet conveying belt 42*c* starts to drive at a predetermined timing point before the sheet P reaches the sheet conveying portion 42.

Then, in Step S3, the controller 10 determines whether the jam of the sheet P is detected in the switchback path 84 based on the detection signal from the sheet detection sensor 9. In Step S3, the controller 10 determines that the jam of the sheet P is detected in the switchback path 84 based on the detection signal from the sheet detection sensor 9.

In this case, the procedure proceeds to Step S4, and the controller 10 outputs a stop signal of the motor 6 which rotatably drives the intermediate transfer belt 31 and a stop signal of the motor 7 which rotatably drives the sheet conveying belt 42*c* at a predetermined timing point. Then, the rotations of the motors 6 and 7 each are stopped at a predetermined timing point.

Thereafter, in Step S5, the controller 10 determines whether the sheet P is left in the secondary transfer portion 4 based on the detection signal of the sheet detection sensor 8. In Step S5, the controller determines that the sheet P is left in the secondary transfer portion 4. In this case, the procedure proceeds to Step S6, the controller 10 displays a message indicating the fact that the sheet P is left in the secondary transfer portion 4 in a display portion 15 serving as an informing portion, and ends the process and waits for the jam processing by the user. In the Step S5, in a case where it is determined that the sheet P is not left in the secondary transfer portion 4, the process is ended.

In the embodiment, the jam of the sheet P occurs in the switchback path 84. At this time, even though a convex loop is formed in the middle portion of the sheet P between the secondary transfer portion 4 and the sheet conveying portion 42 as illustrated in FIG. 2C, the problem that the sheet detection sensor 8 fails to detect the sheet P is solved.

Therefore, the controller 10 makes the motor 7, which rotatably drives the sheet conveying belt 42*c* of the sheet conveying portion 42, advance a distance or more so that the sheet P can be detected by the detection ability of the sheet detection sensor 8. Then, when the loop is formed in the sheet P, the loop is made small until the sheet P can be detected, and then the driving of the motor is stopped.

In other words, the controller 10 stops the motor 6 serving as the first driving portion which rotatably drives the intermediate transfer belt 31. Then, the sheet conveying portion 42 conveys the sheet P only by a distance or more so that the sheet detection sensor 8 can detect the sheet P while releasing the loop of the sheet P formed between a nip portion (between the intermediate transfer belt 31 and the secondary transfer outer-roller 41) and the sheet conveying portion 42. Then, the motor 7 serving as the second driving portion which rotatably drives the sheet conveying belt 42*c* is stopped.

In other words, the controller 10 outputs the stop signal of the motor 6. Then, the sheet conveying portion 42 conveys the sheet P in order not to generate a loop too large to detect the sheet P between the nip portion (between the intermediate transfer belt 31 and the secondary transfer outer-roller 41) and the sheet conveying portion 42, and then the sheet conveying portion 42 is stopped. Alternatively, the sheet P is conveyed by the sheet conveying portion 42 to remove the excessive loop and then the sheet conveying portion 42 is stopped.

Figure 5:
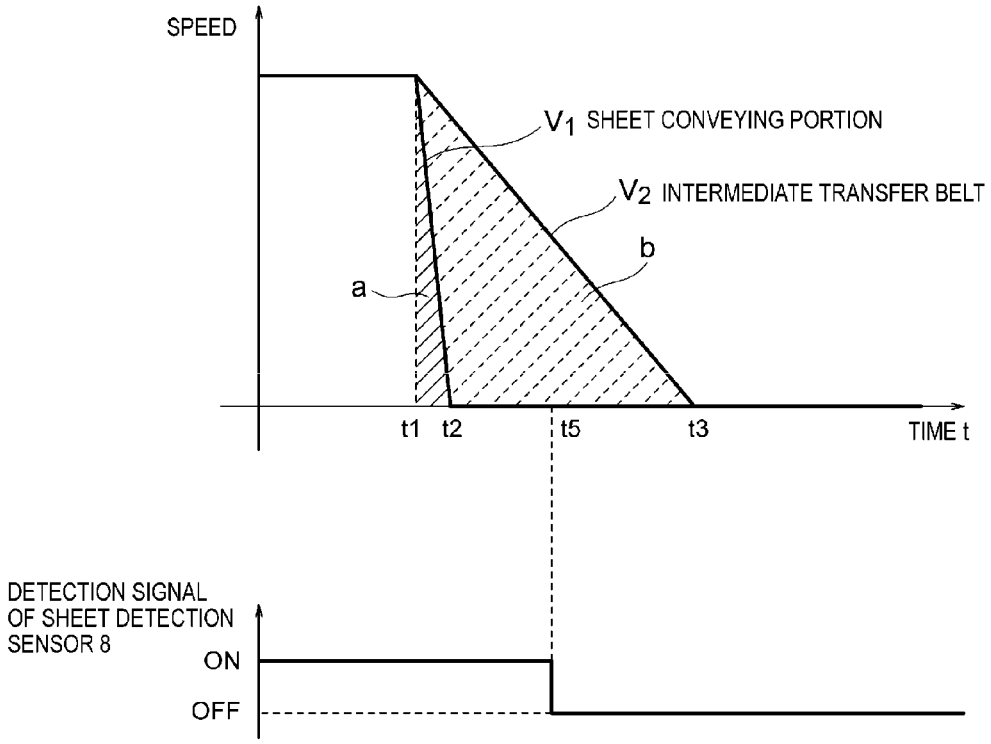
FIG. 5 is a diagram illustrating a comparative example of the stop control of the sheet conveying belt and the intermediate transfer belt.
Figure 6:
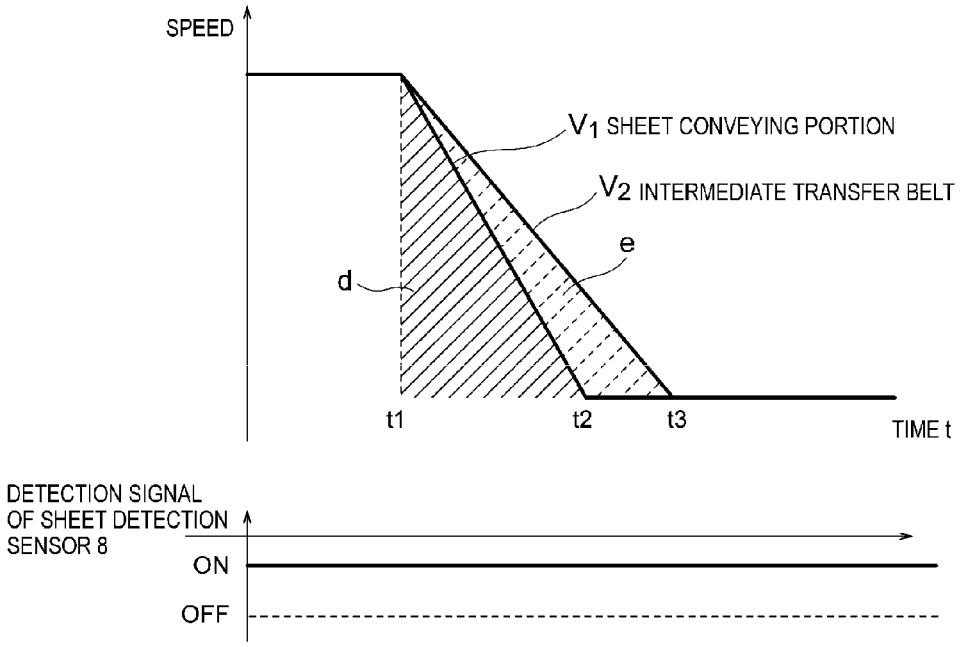
FIG. 6 is a diagram illustrating the stop control of the sheet conveying belt and the intermediate transfer belt in the first embodiment.
Figure 7:
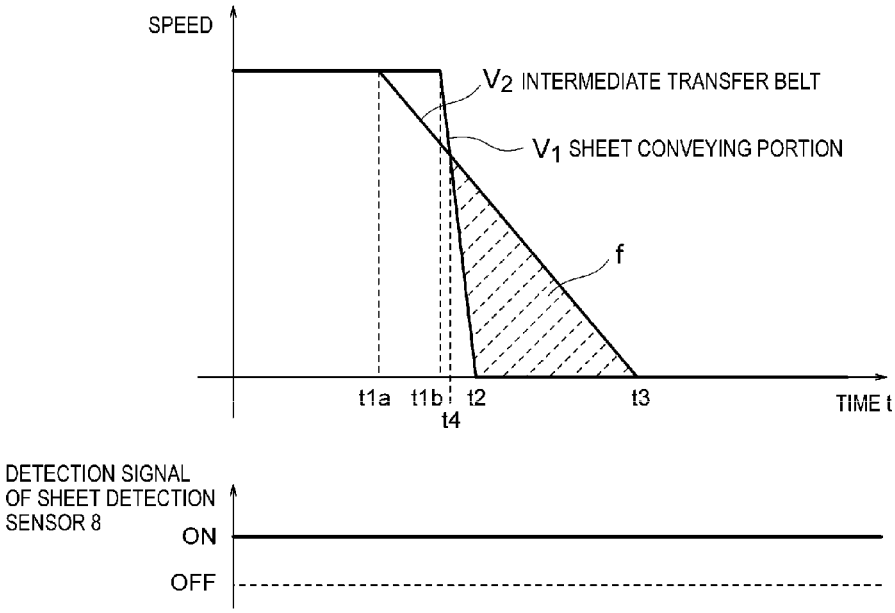
FIG. 7 is a diagram illustrating another stop control of a sheet conveying portion and the intermediate transfer belt in the first embodiment.

As a comparative example, FIG. 5 illustrates a loop amount of the sheet P in a case where the motor 6 which rotatably drives the intermediate transfer belt 31 and the motor 7 which rotatably drives the sheet conveying belt 42*c* are simultaneously stopped. FIGS. 6 and 7 illustrate examples of a stop property of the intermediate transfer belt 31 which is rotatably driven by the motor 6 and a stop control of the motor 7 which rotatably drives the sheet conveying belt 42*c* in the embodiment.

Figure 8A:
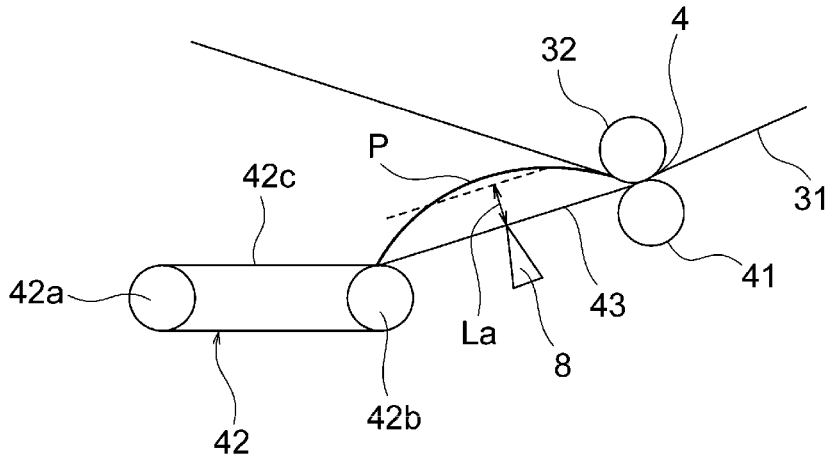
FIG. 8A is a cross-sectional view schematically illustrating a state in which a looped sheet is not able to be detected by a sheet detection portion in the stop control of the sheet conveying belt and the intermediate transfer belt in the comparative example.
Figure 8B:
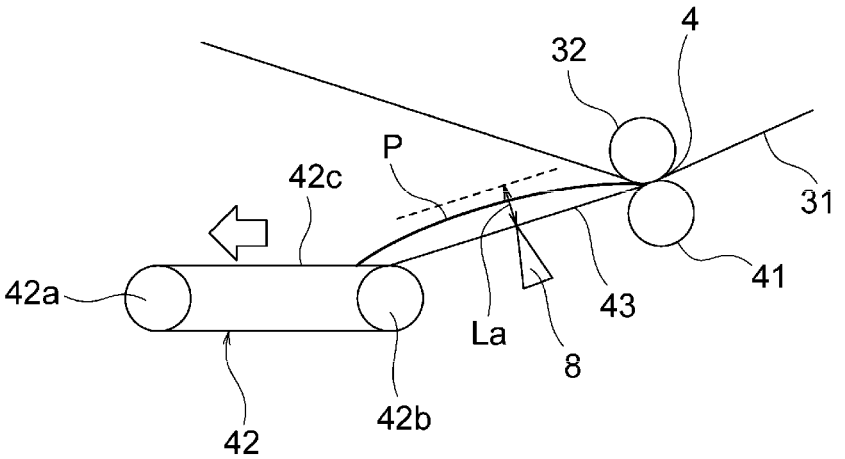
FIG. 8B is a cross-sectional view illustrating a state in which a looped sheet is detected by the sheet detection portion in the stop control of the sheet conveying belt and the intermediate transfer belt in the first embodiment.

FIG. 6 illustrates an example in which the sheet conveying belt 42*c* makes the sheet P advance a distance or more so that the sheet P can be detected within an allowable loop amount La (equal to or less than a detectable loop amount) of the sheet detection sensor 8 illustrated in FIGS. 8A and 8B, and then the motor 7 which rotatably drives the sheet conveying belt 42*c* is stopped. Further, the horizontal axis illustrated in FIGS. 5 to 7 represents time, the vertical axis in the upper portion represents a conveying speed of the sheet P, and the vertical axis on the lower portion represents a detection result indicated by ON/OFF of the sheet detection sensor 8.

FIG. 8A is a cross-sectional view schematically illustrating a loop amount of the sheet P formed between the sheet conveying portion 42 and the intermediate transfer belt 31 in the comparative example. FIG. 8B is a cross-sectional view schematically illustrating a loop amount of the sheet P formed between the sheet conveying portion 42 and the intermediate transfer belt 31 in the embodiment.

In the comparative example illustrated in FIG. 5, the jam of the sheet P is detected by the sheet detection sensor 9 in the switchback path 84. Then, the controller 10 simultaneously outputs the stop signal to the motor 6 which rotatably drives the intermediate transfer belt 31 and the motor 7 which rotatably drives the sheet conveying belt 42*c*.

A conveying speed V1 of the sheet P which is conveyed by the sheet conveying belt 42*c* is set to 340 mm/sec, and a conveying speed V2 of the sheet P which is nipped and conveyed by the nip portion between the intermediate transfer belt 31 and the secondary transfer outer-roller 41 is set to 340 mm/sec. Then, after the jam of the sheet P occurs in the switchback path 84 and the sheet detection sensor 9 detects the jam of the sheet P, the stop signal is simultaneously output to the motors 6 and 7 at time t1 illustrated in FIG. 5.

Having a large inertia property, the intermediate transfer belt 31 is not immediately stopped after the controller 10 outputs the stop signal at time t1, and advances 40 mm as a conveying distance of the sheet P by inertia and then stopped at time t3.

On the other hand, the sheet conveying portion 42 has an inertial property extremely smaller than that of the intermediate transfer belt 31. Therefore, a decelerating speed of the sheet conveying belt 42*c* is set to 50,000 mm/sec$^2$. Then, the sheet conveying belt 42*c* advances 1.4 mm as a conveying distance of the sheet P and is stopped at time t2 ($t1<t2<t3$).

A shaded area a hatched with the solid line of FIG. 5 is the advancing distance (herein, 1.4 mm as a conveying distance of the sheet P) of the sheet P until the sheet conveying belt 42*c* is stopped. A shaded area b hatched with the broken line of FIG. 5 is a difference (herein, 38.6 mm as a conveying distance of the sheet P) of the advancing distance of the sheet P until the intermediate transfer belt 31 and the sheet conveying belt 42*c* are stopped. The difference becomes the loop amount convexly formed in the sheet P on the sheet conveying path between the secondary transfer portion 4 and the sheet conveying portion 42 as illustrated in FIG. 8A.

In the embodiment, as illustrated in FIGS. 8A and 8B, the allowable loop amount La of the sheet detection sensor 8 which can detect the convexly-looped sheet P is the 20 mm or less. Accordingly, as described in the comparative example illustrated in FIG. 8A, in a case where the loop amount of the sheet P exceeds the allowable loop amount La of the sheet detection sensor 8, the sheet P left in the secondary transfer portion 4 is not detected by the sheet detection sensor 8 as illustrated at time t5 of FIG. 5.

FIG. 6 illustrates an example in which the sheet conveying belt 42*c* makes the sheet P advance a distance or more so that the sheet P can be detected within the allowable loop amount La of the sheet detection sensor 8 and then the motor 7 which rotatably drives the sheet conveying belt 42*c* is stopped.

Under the same conditions as the above description with reference to FIG. 5, the decelerating speed of the sheet conveying belt 42*c* is set to 2,000 mm/sec$^2$, and the sheet conveying belt 42*c* advances 30.2 mm as a conveying distance of the sheet P and the sheet conveying belt 42*c* is stopped at time t2.

A shaded area d hatched with the solid line of FIG. 6 is an advancing distance (herein, 30.2 mm as a conveying distance of the sheet P) of the sheet P until the sheet conveying belt 42*c* is stopped. A shaded area e hatched with the broken line of FIG. 6 is a difference (herein, 9.8 mm as a conveying distance of the sheet P) of the advancing distance of the sheet P until the intermediate transfer belt 31 and the sheet conveying belt 42*c* are stopped. The difference becomes the loop amount convexly formed in the sheet P on the sheet conveying path between the secondary transfer portion 4 and the sheet conveying portion 42 as illustrated in FIG. 8B.

In the embodiment, as illustrated in FIGS. 8A and 8B, the allowable loop amount La of the sheet detection sensor 8 which can detect the convexly-looped sheet P is the 20 mm or less. Accordingly, as illustrated in FIG. 8B, since the loop amount of the sheet P is equal to or less than the allowable loop amount La (equal to or less than the detectable loop amount) of the sheet detection sensor 8, it is possible to detect the sheet P left in the secondary transfer portion 4 by the sheet detection sensor 8.

FIG. 6 illustrates an example of control in which the decelerating speed of the sheet conveying belt 42*c* is set such that time t2 at which the sheet conveying belt 42*c* is completely stopped is earlier than time t3 at which the intermediate transfer belt 31 is completely stopped ($t3>t2$). The decelerating speed of the sheet conveying belt 42*c* can be appropriately changed by controlling pulses which are input to the motor 7 serving as a stepping motor.

As another configuration, the decelerating property (the decelerating speed) of the intermediate transfer belt 31 may be set to be equal to the decelerating speed of the sheet conveying belt 42*c* so that time t2 at which the sheet conveying belt 42*c* is completely stopped is matched with time t3 at which the intermediate transfer belt 31 is completely stopped. As still another configuration, the decelerating speed of the sheet conveying belt 42*c* may be set to cause time t2 at which the sheet conveying belt 42*c* is completely stopped to be slightly lagged behind time t3 at which the intermediate transfer belt 31 is completely stopped. In other words, since the intermediate transfer belt 31 is rotated by an inertial force after the stop signal is issued to the motor 6, the sheet conveying belt 42*c* is caused to convey the sheet P by a distance according to an advancing amount of the sheet P by the intermediate transfer belt 31, and then the sheet conveying belt 42*c* is stopped.

In this way, the decelerating speed of the sheet conveying belt 42*c* is set according to the stop property of the intermediate transfer belt 31 which is not immediately stopped due to its own inertia. Then, the setting is made such that a loop equal to about the amount that the sheet detection sensor 8 fails to detect the sheet P is not formed in the sheet P left between the secondary transfer portion 4 and the sheet conveying portion 42.

In FIG. 7, after the sheet P jammed in the switchback path 84 is detected by the sheet detection sensor 9, the controller 10 outputs the stop signal at time t1a to the motor 6 which rotatably drives the intermediate transfer belt 31. Then, the controller outputs the stop signal at time t1b (t1b>t1a) after a predetermined time to the motor 7 which rotatably drives the sheet conveying belt 42*c*.

In a case where the motors 6 and 7 illustrated in FIG. 7 are controlled to be stopped, a loop is formed in the sheet P from time t4 at which the sheet conveying speed V1 of the sheet conveying belt 42*c* becomes smaller than the sheet conveying speed V2 of the intermediate transfer belt 31.

Therefore, a shaded area f hatched with the broken line of FIG. 7 is a difference of the advancing distance of the sheet P until the intermediate transfer belt 31 and the sheet conveying belt 42*c* each are stopped. The difference becomes the loop amount convexly formed in the sheet P on the sheet conveying path between the secondary transfer portion 4 and the sheet conveying portion 42.

In this case, the controller 10 makes the sheet conveying belt 42*c* advance so that the loop amount formed in the sheet P becomes smaller than the allowable loop amount La of the sheet detection sensor 8 to detect the sheet P, and stops the motor 7.

In this way, the controller 10 performs the following control in order to prevent the sheet P left between the secondary transfer portion 4 and the sheet conveying portion 42 from being looped as large as that the sheet detection sensor 8 fails to detect the sheet P. In other words, as illustrated in FIG. 7, time t1b at which the stop signal is output to the motor 7 which rotatably drives the sheet conveying belt 42*c* is set to be lagged behind time t1a at which the stop signal is output to the motor 6 which rotatably drives the intermediate transfer belt 31.

Further, as another configuration, time t1b at which the stop signal is issued to the motor 7 which rotatably drives the sheet conveying belt 42*c* is set to be lagged behind time t1a at which the stop signal is issued to the motor 6 which rotatably drives the intermediate transfer belt 31. Further, the decelerating speed of the sheet conveying belt 42*c* may be set according to the stop property of the intermediate transfer belt 31 in inertia.

Further, a distance of the sheet P conveyed by the sheet conveying belt 42*c* in order to make the sheet detection sensor 8 enable to detect the sheet P left in the secondary transfer portion 4 is as follows. In other words, the conveying distance of the sheet P can be appropriately set by the rotation distance of the intermediate transfer belt 31 in inertia after the motor 6 which rotatably drives the intermediate transfer belt 31 is stopped, and the allowable loop amount La of the sheet P which can be detected by the sheet detection sensor 8.

Second Embodiment

Figure 9:
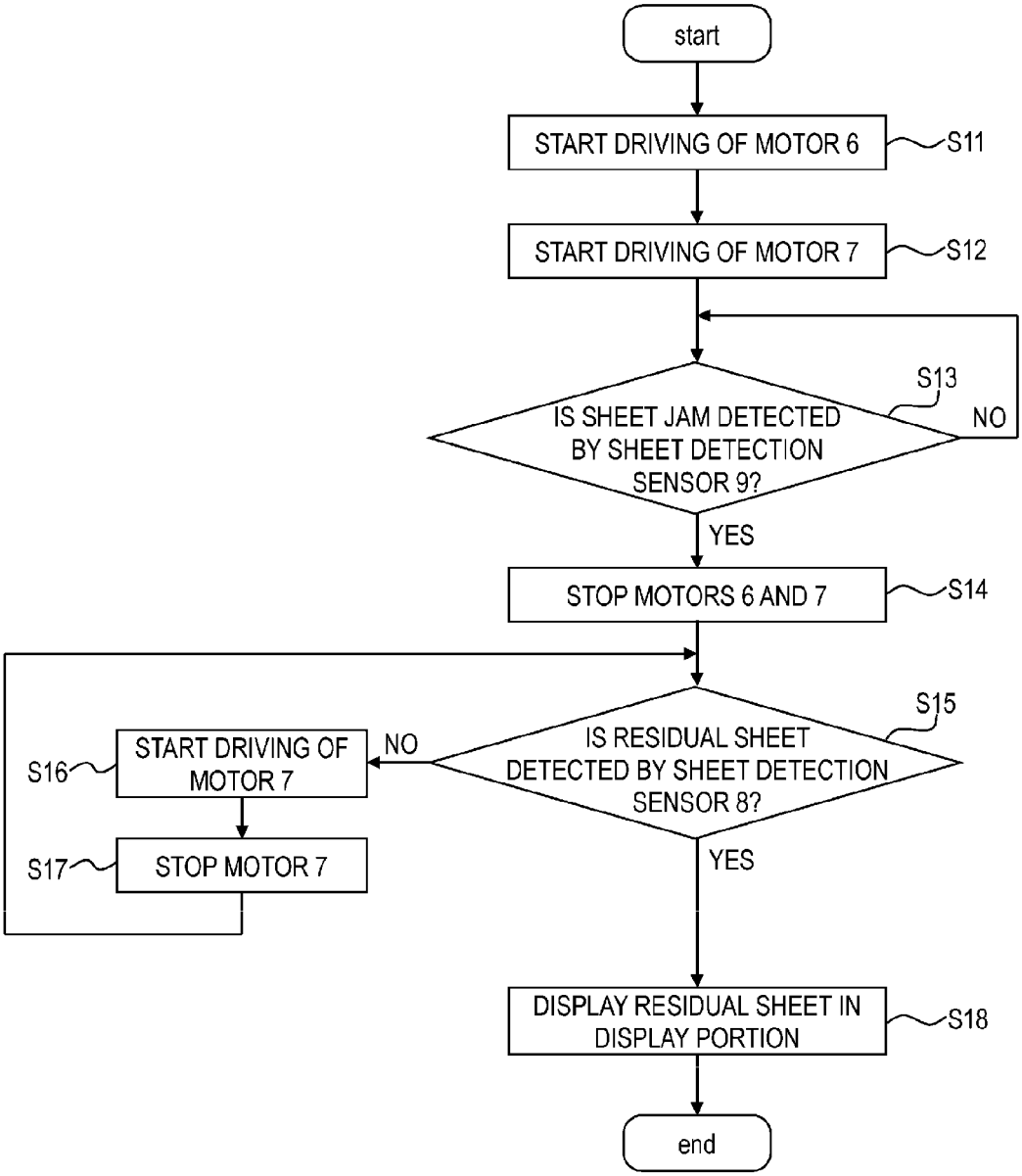
FIG. 9 is a flowchart illustrating stop control of an intermediate transfer belt and a sheet conveying belt when a sheet jam occurs in a second embodiment of the image forming apparatus according to the invention.

Next, the configuration of the second embodiment of the image forming apparatus according to the invention will be described using FIGS. 9 and 10. Further, the same configurations as those in the first embodiment will be denoted with the same reference numerals or the same member names even different reference numerals, and the descriptions thereof will not be repeated.

In the first embodiment, the decelerating speed of the sheet conveying belt 42*c* is set according to the stop property of the intermediate transfer belt 31 having a large inertia. With this configuration, the setting is made such that a loop equal to about the amount that the sheet detection sensor 8 fails to detect the sheet P is not formed in the sheet P left between the secondary transfer portion 4 and the sheet conveying portion 42.

In the embodiment, the intermediate transfer belt 31 and the sheet conveying belt 42*c* are stopped. Then, the loop of the sheet P left between the secondary transfer portion 4 and the sheet conveying portion 42 is made small by rotatably driving the sheet conveying belt 42*c* again, so that the sheet P can be detected by the sheet detection sensor 8.

<Stop Control Operation of Sheet Conveying Portion>

A description will be made, using FIG. 9, about a stop control operation which is performed on the intermediate transfer belt 31 and the sheet conveying portion 42 by the controller 10 of the image forming apparatus 1 when the jam occurs, according to the embodiment. FIG. 9 is a flowchart illustrating states in which the stop control operation on the intermediate transfer belt 31 and the sheet conveying portion 42 is performed by the controller 10 of the image forming apparatus 1 according to the embodiment when the jam occurs. In Step S11 of FIG. 9, when a printing job is started by the image forming apparatus 1, the motor 6 which rotatably drives the intermediate transfer belt 31 starts to drive, and an image forming operation starts.

Next, in Step S12, the motor 7 which rotatably drives the sheet conveying belt 42*c* starts to drive at a predetermined timing point before the sheet P reaches the sheet conveying portion 42. Next, in Step S13, the controller 10 determines whether the sheet P is jammed in the switchback path 84 illustrated in FIG. 1 based on the detection result of the sheet detection sensor 9.

In Step S13, the controller 10 determines that the sheet P is jammed in the switchback path 84 illustrated in FIG. 1 based on the detection result of the sheet detection sensor 9. In this case, the procedure proceeds to Step S14, the controller 10 simultaneously outputs the stop signal of the motor 6 which rotatably drives the intermediate transfer belt 31 and the stop signal of the motor 7 which rotatably drives the sheet conveying belt 42*c* at time t1 illustrated in FIG. 10.

Next, in Step S15, the controller 10 determines whether the sheet P is left in the secondary transfer portion 4 illustrated in FIG. 1 based on the detection result of the sheet detection sensor 8.

In Step S15, the controller 10 determines that the sheet P is not left in the secondary transfer portion 4 illustrated in FIG. 1 based on the detection result of the sheet detection sensor 8. In this case, the procedure proceeds to Step S16, and the driving of the motor 7 which rotatably drives the sheet conveying belt 42*c* is started again. Then, after the sheet P is conveyed by the sheet conveying belt 42*c* to release the loop formed in the sheet P, the procedure proceeds to Step S17, and the motor 7 which rotatably drives the sheet conveying belt 42*c* is stopped.

Then, the procedure returns to Step S15 in which the controller 10 determines again whether the sheet P is left in the secondary transfer portion 4 illustrated in FIG. 1 based on the detection result of the sheet detection sensor 8. In Step S15, the controller 10 determines that the sheet P is left in the secondary transfer portion 4 illustrated in FIG. 1 based on the detection result of the sheet detection sensor 8. In this case, the procedure proceeds to Step S18 in which the controller 10 displays a message indicating the fact that the sheet P is left in the secondary transfer portion 4 in a display portion 15 serving as an informing portion, and ends the process and waits for the jam processing by the user.

That is, in the embodiment, after stopping the motor 7 which rotatably drives the sheet conveying belt 42*c* in Step S14, the controller 10 determines whether the sheet P is left in the secondary transfer portion 4 based on the detection signal of the sheet detection sensor 8. There is a case where the sheet P left in the secondary transfer portion 4 is not detected by the sheet detection sensor 8. In this case, the motor 7 which rotatably drives the sheet conveying belt 42*c* is driven again on the assumption that a loop is formed in excess of the allowable loop amount La of the sheet P which is detectable by the sheet detection sensor 8. Then, in a case where the sheet detection sensor 8 detects the sheet P left in the secondary transfer portion 4, the fact that the sheet P is left in the secondary transfer portion 4 is displayed in the display portion 15.

Figure 10:
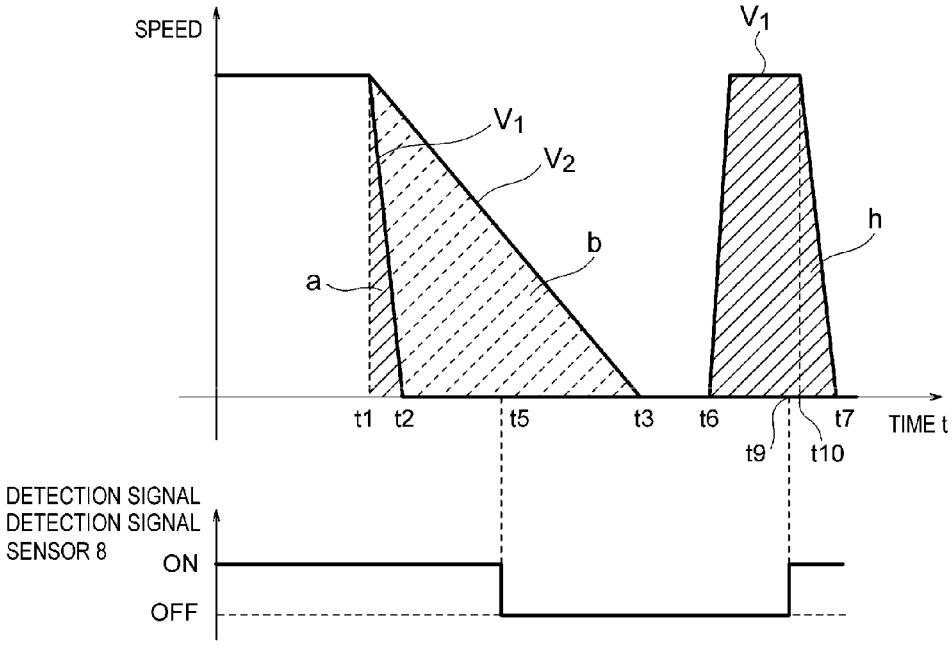
FIG. 10 is a diagram illustrating the stop control of the sheet conveying belt and the intermediate transfer belt in the second embodiment.

FIG. 10 illustrates the stop control operation of the sheet conveying portion 42 and the intermediate transfer belt 31 in the embodiment. The horizontal axis illustrated in FIG. 10 represents time, and the vertical axis in the upper portion represents the conveying speed of the sheet P, and the vertical axis in the lower portion represents the detection result indicated by ON/OFF of the sheet detection sensor 8.

In FIG. 10, the jam of the sheet P is detected by the sheet detection sensor 9 which is provided in the switchback path 84 illustrated in FIG. 1. Then, at time t1, the controller 10 simultaneously outputs the stop signal to the motor 6 which rotatably drives the intermediate transfer belt 31 and the motor 7 which rotatably drives the sheet conveying belt 42*c*.

A conveying speed V1 of the sheet P which is conveyed by the sheet conveying belt 42*c* is set to 340 mm/sec, and a conveying speed V2 of the sheet P which is nipped and conveyed by the nip portion between the intermediate transfer belt 31 and the secondary transfer outer-roller 41 is set to 340 mm/sec.

The jam of the sheet P is detected by the sheet detection sensor 9 which is provided in the switchback path 84 illustrated in FIG. 1. Then, at time t1, the controller 10 simultaneously outputs the stop signal to the motor 6 which rotatably drives the intermediate transfer belt 31 and the motor 7 which rotatably drives the sheet conveying belt 42*c*. The intermediate transfer belt 31 having a large inertia property is not immediately stopped after the stop signal is output, and advances 40 mm as a conveying distance of the sheet P by inertia and then stopped at time t3.

On the other hand, in a case where the sheet conveying belt 42*c* having an inertial property extremely smaller than that of the intermediate transfer belt 31 is set to have a decelerating speed of 50,000 mm/sec$^2$, the sheet conveying belt advances 1.4 mm as a conveying distance of the sheet P and is stopped at time t2 (t2<t3).

Similarly to the comparative example illustrated in FIG. 5, a shaded area a hatched with the solid line of FIG. 7 is the advancing distance (herein, 1.4 mm as a conveying distance of the sheet P) of the sheet P until the sheet conveying belt 42*c* is stopped. A shaded area b hatched with the broken line of FIG. 7 is a difference (herein, 38.6 mm as a conveying distance of the sheet P) of the advancing distance of the sheet P until the intermediate transfer belt 31 and the sheet conveying belt 42*c* are stopped. The difference becomes the loop amount convexly formed in the sheet P on the sheet conveying path between the secondary transfer portion 4 and the sheet conveying portion 42 as illustrated in FIG. 8A.

In the embodiment, as illustrated in FIG. 8A, the allowable loop amount La of the sheet detection sensor 8 which can detect the convexly-looped sheet P is the 20 mm or less. Accordingly, as the comparative example illustrated in FIG. 8A, the loop amount of the sheet P may exceed the allowable loop amount La of the sheet detection sensor 8. In this case, as illustrated at time t5 to time t9 of FIG. 10, it is not possible for the sheet detection sensor 8 to detect the sheet P left in the secondary transfer portion 4.

In the embodiment, in a case where the sheet P left in the secondary transfer portion 4 is not detected by the sheet detection sensor 8, it is assumed that a loop is formed in excess of the allowable loop amount La of the sheet P which is detectable by the sheet detection sensor 8. Then, the motor 7 is driven again at time t6 (t6>t3), and rotatably drives the sheet conveying belt 42*c* at an accelerating speed of 50,000 mm/sec$^2$. Therefore, the loop of the sheet P becomes small.

Then, at time t10 after 0.05 sec from time t6 illustrated in FIG. 10, the controller 10 outputs the stop signal to the motor 7 which rotatably drives the sheet conveying belt 42*c*. When the decelerating speed of the sheet conveying belt 42*c* is set to 50,000 mm/sec$^2$, the sheet conveying belt further advances 1.4 mm as a conveying distance of the sheet P and stops at time t7 (t7<t10).

The total sum of a shaded area h hatched with the solid line of FIG. 10 becomes 21.4 mm as a conveying distance of the sheet P which advances until the sheet conveying belt 42*c* is driven again and stops. In the embodiment, the allowable loop amount La for the detection of the sheet P using the sheet detection sensor 8 becomes 20 mm or less. With this configuration, it is possible to reliably detect the sheet P left in the secondary transfer portion 4 by the sheet detection sensor 8. Other configurations are comprised similarly to those of the first embodiment, and the same effects can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-212640, filed Oct. 10, 2013, which is hereby incorporated by reference herein in its entirety.

What is claimed is:

1. An image forming apparatus comprising:

an image bearing member which bears a toner image;

a DC motor which drives the image bearing member;

a transfer portion which nips a sheet with the image bearing member and transfers the toner image to the sheet from the image bearing member;

a fixing unit which fixes the toner image to the sheet;

a sheet conveying unit which conveys the sheet with the toner image transferred by the transfer portion from the transfer portion to the fixing unit;

a stepping motor which drives the sheet conveying unit corresponding to the input pulses;

a sheet detector which detects the sheet between the transfer portion and the sheet conveying unit; and a controller which controls the DC motor and the stepping motor, wherein the controller simultaneously commences stopping processes of the DC motor and the stepping motor, and controls a deceleration rate of the stepping motor by controlling input pulses in a manner that the sheet conveying unit completely stops after the image bearing member completely stops, so that the sheet detector can detect the sheet nipped between the image bearing member and the transfer portion.

2. The image forming apparatus according to claim 1, wherein, the controller controls a deceleration rate of the stepping motor so that a carrying distance of the sheet between commencement of the stopping process by the stepping motor and complete stop of the stepping motor is larger than a carrying distance of the sheet by the rotation of the bearing member due to inertial force after commencing the stopping process of DC motor.

3. The image forming apparatus according to claim 1, wherein the image bearing member is an intermediate transfer belt onto which the toner image is transferred from a photosensitive member.

4. The image forming apparatus comprising according to claim 1, wherein the sheet conveying unit has a sheet conveying belt which conveys the sheet to the fixing unit.

5. The image forming apparatus according to claim 1, wherein the image bearing member is an intermediate transfer belt onto which the toner image is transferred from a photosensitive member.

6. An image forming apparatus comprising:

an image bearing member which bears a toner image;

a first driving member which drives the image bearing member;

a transfer portion facing the image bearing member and which transfers the toner image to the sheet from the image bearing member;

a fixing unit which fixes the toner image to the sheet;

a sheet conveying unit which conveys the sheet with the toner image transferred by the transfer portion from the transfer portion to the fixing unit;

a second driving member which drives the sheet conveying unit;

a first sheet detecting portion which detects the sheet between the transfer portion and the sheet conveying unit;

a second sheet detecting portion which detects a jam of the sheet; and a controller which controls the first driving member and the second driving member, and identifies a jam of the sheet according to the detecting result from the second sheet detecting portion, wherein when the controller identifies a jam of the sheet, the controller simultaneously commences a stopping process of the first driving member and the second driving member and after the first driving member and the second driving member are stopped the controller restarts the second driving member so as to decrease a loop amount of the sheet which occurs by a difference of moving distances of the sheet by the image bearing member and the sheet conveying unit from commencement of the stopping process until actual stoppage thereof so that the first detecting portion can detect the sheet.

7. The image forming apparatus comprising according to claim 6, wherein after the controller simultaneously commences the stopping process of the first driving member and the second driving member to stop the image bearing member and the sheet conveying unit in a case where the controller detects a jam of sheet, the controller determines if a sheet remains between the transfer portion and the sheet conveying unit according to detection result from the first sheet detecting portion, and the controller re-starts the second driving member in a case where the controller determines that a sheet does not remain.

* * * * *